US008494188B2

(12) United States Patent
Yu et al.

(10) Patent No.: US 8,494,188 B2
(45) Date of Patent: Jul. 23, 2013

(54) PIEZOELECTRIC CERAMIC LOUDSPEAKER HEADPHONE STRUCTURE

(75) Inventors: Hsiang-Chih Yu, Zhonghe (TW); Chia-Hung Chiu, Banqiao (TW)

(73) Assignees: Abatech Electronics Co., Ltd., Taipei County (TW); Hsiang-Chih Yu, Taipei County (TW); Chia-Hung Chiu, Taipei County (TW)

( * ) Notice: Subject to any disclaimer, the term of this patent is extended or adjusted under 35 U.S.C. 154(b) by 278 days.

(21) Appl. No.: 12/983,332

(22) Filed: Jan. 3, 2011

(65) Prior Publication Data

US 2012/0170786 A1 Jul. 5, 2012

(51) Int. Cl.
*H04R 25/00* (2006.01)

(52) U.S. Cl.
USPC ..... 381/190; 381/371

(58) Field of Classification Search
USPC ..... 381/171, 173, 190, 370, 371; 181/129; 310/311, 328, 348
See application file for complete search history.

(56) References Cited

U.S. PATENT DOCUMENTS 4,005,278 A * 1/1977 Gorike ..... 381/371
4,158,753 A * 6/1979 Gorike ..... 381/371

* cited by examiner

*Primary Examiner* — Brian Ensey
(74) *Attorney, Agent, or Firm* — Leong C. Lei

(57) ABSTRACT

A piezoelectric ceramic loudspeaker headphone structure includes a positioning frame having an open front end and an open rear that form a circumferential step extending along an inner circumference of the positioning frame. A steel sheet having an area approximately equal to the open front end of the positioning frame is mounted to and closes the open front end of the positioning frame. A vibrating member is received in and positioned by the circumferential step so as to close the rear open end of the positioning frame. The positioning frame with the steel sheet and the vibrating member respectively closing the front and rear ends thereof forms a closed chamber. A sound-making member that is formed by stacking multiple ceramic layers has a surface area less than that of the steel sheet and is attached to an outside surface of the steel sheet to constitute a sound-making module.

7 Claims, 5 Drawing Sheets

PIEZOELECTRIC CERAMIC LOUDSPEAKER HEADPHONE STRUCTURE

BACKGROUND OF THE INVENTION (a) Technical Field of the Invention

The present invention relates to a piezoelectric ceramic loudspeaker headphone structure, and more particularly to a piezoelectric ceramic loudspeaker headphone structure that is free of magnetism without influencing electronic products and is thinned due to omitting voice coils, which thus can be conveniently carried along.

(b) Description of the Prior Art

With the rapid progress of science and technology, common 3C products such as mobile phones or notebook computers have been widely applied. Correspondingly, headphones used in these 3C products become more and more elaborate. Since conventional headphones are formed by magnets and voice coils, the headphones are magnetic, which may influence electronic products. Moreover, due to the winding thickness of voice coils, it is difficult for conventional headphones to be miniaturized, not mentioning becoming thinner and lighter. As a result, the conventional headphones cannot meet the portable requirements. Furthermore, as for a thinned headphone, a reproduction of high, medium and low audio frequencies needs to be considered, so that it is really unacceptable for a dealer and a consumer that the headphone gets a thinned configuration at the expense of its audio frequency effects. In view of the above, the applicant of the present invention has made improvements to make headphones free of magnetism and produce better sound effects after years of experience and continuous research and experiments in this field.

SUMMARY OF THE INVENTION

A main object of the present invention is to provide a piezoelectric ceramic loudspeaker headphone structure, in which the headphone is free of magnetism without influencing an electronic product and is thinned due to omitting voice coils, and thus can be conveniently carried along.

The piezoelectric ceramic loudspeaker headphone structure includes a positioning frame, a steel sheet and a vibrating member. A step portion is disposed in an inner edge at the rear of the positioning frame. The steel sheet has an area approximately equal to that of the positioning frame and is disposed with a sound-making member stacked by a plurality of ceramic material layers. A lead wire is welded to the sound-making member. The vibrating member is a sheet body and has an area approximately equal to that of the step portion of the positioning frame. The steel sheet is disposed at a front edge of the positioning frame. The vibrating member is embedded in the step portion of the positioning frame, and thus a sound-making module is formed. The sound-making module is assembled to a headphone, and after the sound-making member receives an audio signal, a sound is guided out through response of the vibrating member. Therefore, the headphone is free of magnetism without influencing electronic products such as mobile phones or notebook computers, and is thinned due to omitting voice coils, which thus can be conveniently carried along.

DETAILED DESCRIPTION OF THE PREFERRED EMBODIMENTS

Figure 1:
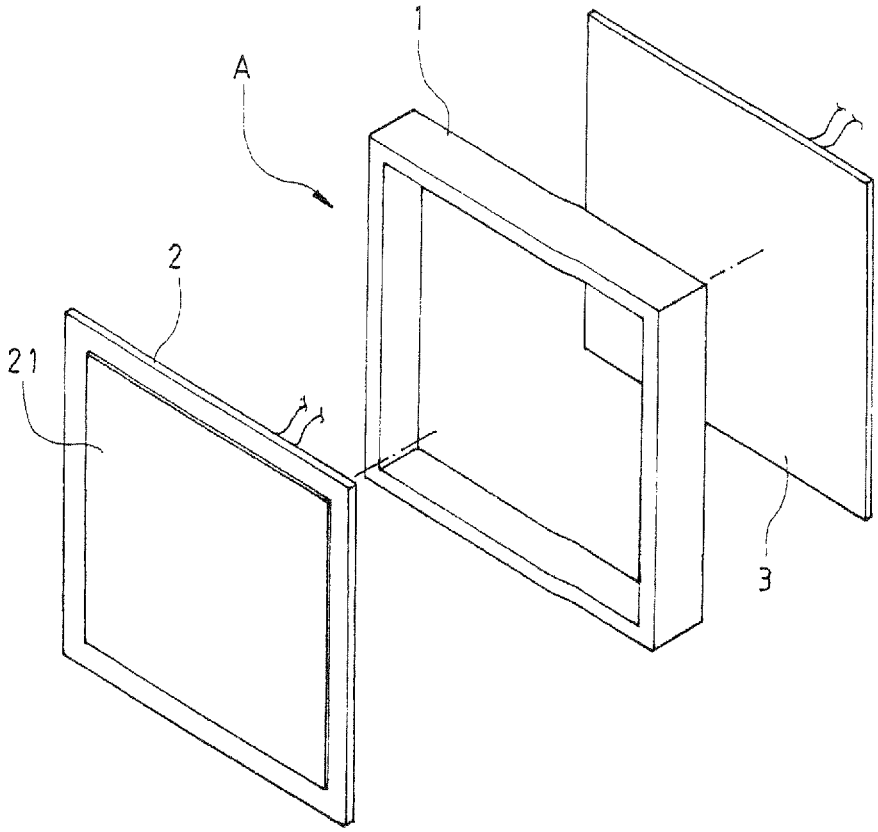
FIG. 1 is a three-dimensional exploded view of a sound-making module according to the present invention.
Figure 2:
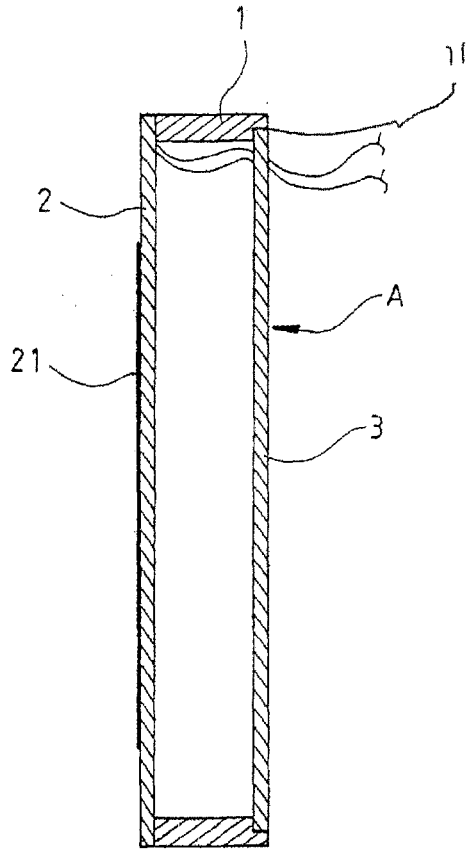
FIG. 2 is a sectional view of a sound-making module according to the present invention.
Figure 3:
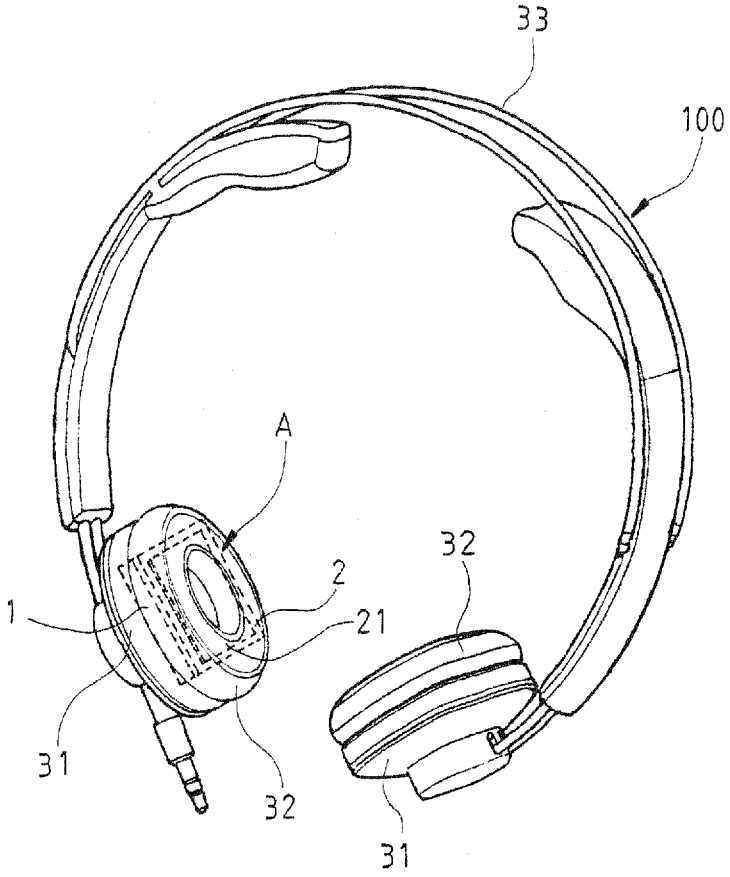
FIG. 3 is a view of an embodiment of the present invention when being assembled to a headphone.

FIG. 1, FIG. 2 and FIG. 3 are respectively a three-dimensional exploded view, a sectional view of a sound-making module according to the present invention and a view of an embodiment of the present invention when being assembled to a headphone. Referring to FIG. 1, FIG. 2 and FIG. 3, the present invention mainly includes a positioning frame 1, a steel sheet 2 and a vibrating member 3. A lower step portion 11 is disposed in an inner edge at the rear of the positioning frame 1. The steel sheet 2 has an area approximately equal to that of the positioning frame 1, and is disposed with a sound-making member 21 stacked by a plurality of ceramic material layers. A lead wire is welded to the sound-making member. The vibrating member 3 is a sheet body and has an area approximately equal to that of the step portion 11 of the positioning frame 1.

With the above members, the steel sheet 2 is disposed at a front edge of the positioning frame 1, and the vibrating member 3 is embedded in the step portion 11 of the positioning frame 1, and thus a sound-making module A is formed. In this embodiment, two sound-making modules A are assembled to fixed mounts 31, ear muffs 32 are disposed to the fixed mounts 31 and a hanging support 33 connected to the fixed mounts 31 is further disposed, and thus a headphone 100 is formed for fitting on the head. When a user wears the ear muffs 32 against the ears, each sound-making member 21 of the steel sheet 2 receives an audio signal, and then a sound is guided out through response of the vibrating member 3. Therefore, the headphone 100 is free of magnetism without influencing electronic products such as mobile phones or notebook computers, and is thinned due to omitting voice coils, which thus can be conveniently carried along.

Figure 4:
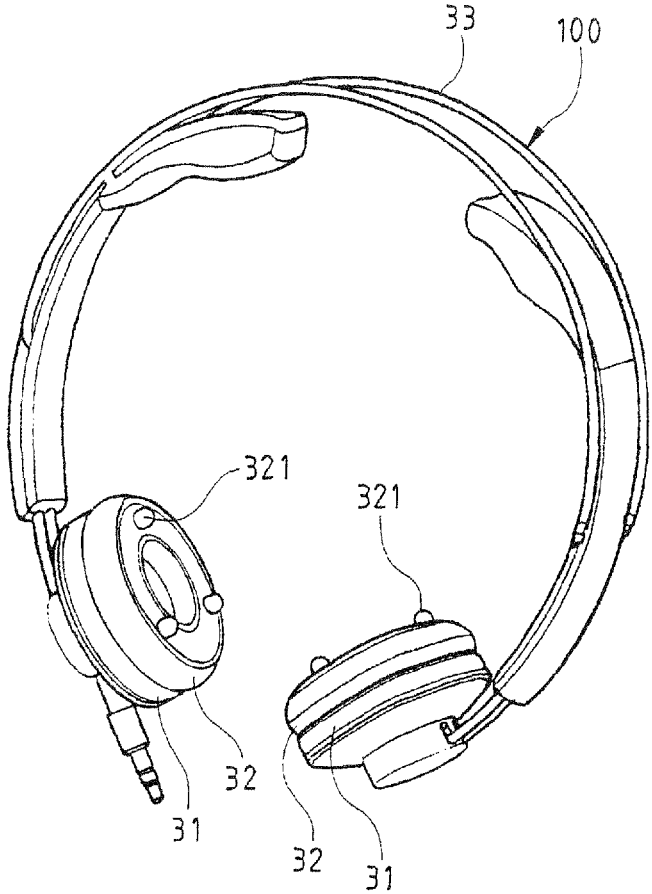
FIG. 4 is a three-dimensional view of another embodiment of the present invention.

Referring to FIG. 4, FIG. 4 is a three-dimensional view of another embodiment of the present invention. Further, referring to FIG. 3, as shown in these two figures, the present invention may dispose a plurality of projecting pillars 321, spaced apart by an appropriate distance, on a surface of each ear muff 32 of the headphone 100. When the headphone 100 is used, these projecting pillars 321 can push against a peripheral edge of the ear, so that each sound-making module A disposed on the fixed mount 31 keeps certain distance away from the ear, thereby making the transmitted sound become even better.

Figure 5:
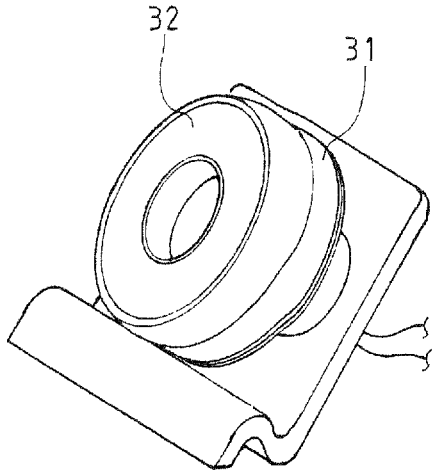
FIG. 5 is a three-dimensional view of yet another embodiment of the present invention.

Referring to FIG. 5, FIG. 5 is a three-dimensional view of yet another embodiment of the present invention. Furthermore, referring to FIG. 3, as shown in these two figures, the present invention may disassemble the fixed mount 31 disposed with the sound-making module A and the ear muff 32, and place them on a desktop alone, so that sound can be directly sent out from the ear muff 32 to get an effect of a miniaturized loudspeaker, thereby forming another aspect of the present invention.

Compared with a conventional headphone, the present invention has at least the following advantages:

1. The headphone of the present invention is further thinned, so that it can be used more widely and is more convenient to carry along.

2. The headphone of the present invention makes sound by disposing the steel sheet 2 to the positioning frame 1, so that the medium frequency and the high frequency are not distorted, and the reproduction of the original sound achieves a better effect.

3. In the present invention, the vibrating member 3 can compensate for sound dissipation, so that the overall sound effects are more stable. The vibrating member 3 also has an excellent guiding effect at low frequency, which may reach 200 Hz, so the low frequency sound is not dissipated.

In summary, the present invention uses a positioning frame, a vibrating member, together with a steel sheet disposed on the positioning frame to form a sound-making module. The sound-making module is assembled to a headphone. Therefore, the headphone is free of magnetism without influencing electronic products such as mobile phones or notebook computers, and is thinned due to omitting voice coils, which thus can be conveniently carried along.

We claim:

1. A piezoelectric ceramic headphone structure, comprising:

a positioning frame having an open front end and an open rear end;

a steel sheet, having an area approximately equal to that of the positioning frame, disposed at and closing the front end of the positioning frame, and provided with a sound-making member that is formed by stacking a plurality of ceramic material layers and has a surface area smaller than the area of the steel sheet;

a vibrating member, being shaped as a sheet body attached to and closing the rear end of the positioning frame and opposing the steel sheet;

wherein a sound-making module is formed of a closed chamber delimited by the steel sheet that carries the sound-making member and the vibrating member respectively closing the front end and the rear end of the positioning frame, whereby after the sound-making member of the steel sheet receives an audio signal, a sound is guided out through response of the vibrating member.

2. The piezoelectric ceramic headphone structure of claim 1, wherein a step portion is disposed at the rear end of the positioning frame, so that the vibrating member is embedded and fixed at the step portion.

3. The piezoelectric ceramic headphone structure of claim 1, wherein the positioning frame is made of base paper.

4. The piezoelectric ceramic headphone structure of claim 1, wherein the positioning frame is made of cloth.

5. The piezoelectric ceramic headphone structure of claim 1, wherein the positioning frame is made of wood chip.

6. The piezoelectric ceramic headphone structure of claim 1, wherein the positioning frame is made of foam.

7. The piezoelectric ceramic loudspeaker headphone structure of claim 1, wherein the positioning frame is made of polyethylene terephthalate (PET), polyethylene naphthalate (PEN) and polyetherimide (PEI).

* * * * *